US009971286B2

(12) United States Patent
Kikegawa et al.

(10) Patent No.: US 9,971,286 B2
(45) Date of Patent: May 15, 2018

(54) CONTROL METHOD OF IMAGE FORMING APPARATUS

(71) Applicants: Ryuichi Kikegawa, Kanagawa (JP); Tsukasa Satoh, Kanagawa (JP)

(72) Inventors: Ryuichi Kikegawa, Kanagawa (JP); Tsukasa Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/586,318

(22) Filed: May 4, 2017

(65) Prior Publication Data

US 2017/0336740 A1 Nov. 23, 2017

(30) Foreign Application Priority Data

May 20, 2016 (JP) ..... 2016-101545

(51) Int. Cl.
*G03G 15/20* (2006.01)

(52) U.S. Cl.
CPC ..... *G03G 15/205* (2013.01); *G03G 15/2039* (2013.01)

(58) Field of Classification Search
CPC ..... G03G 15/205; G03G 15/2039
See application file for complete search history.

(56) References Cited

U.S. PATENT DOCUMENTS 9,740,158 B2 * 8/2017 Kosaka ..... G03G 15/80
2006/0039713 A1 2/2006 Kishi et al.
2006/0051111 A1 3/2006 Kishi et al.
2006/0051112 A1 3/2006 Matsusaka et al.
2006/0051113 A1 3/2006 Kishi et al.
2006/0051119 A1 3/2006 Kishi et al.
2006/0051120 A1 3/2006 Kishi et al.
2006/0051121 A1 3/2006 Matsusaka et al.
2006/0127118 A1 6/2006 Kishi et al.
2007/0036570 A1 * 2/2007 Tatematsu ..... G03G 15/205 399/69
2008/0145088 A1 6/2008 Matsusaka et al.
2009/0196643 A1 8/2009 Mito et al.
2013/0236220 A1 9/2013 Mito et al.
2014/0193175 A1 7/2014 Kato et al.
(Continued)

FOREIGN PATENT DOCUMENTS

JP 2015-210355 11/2015

*Primary Examiner* — Rodney Bonnette
(74) *Attorney, Agent, or Firm* — Oblon, McClelland, Maier & Neustadt, L.L.P.

(57) ABSTRACT

A control method of an image forming apparatus including a fixing rotator includes transiting the image forming apparatus to a standby mode; detecting a temperature of the fixing rotator when the image forming apparatus is in the standby mode; determining that the fixing rotator is in a low temperature state that does not satisfy a predetermined heating condition based on the detected temperature of the fixing rotator; detecting at least one of an electric voltage, an electric current, and an electric power input to the image forming apparatus when the image forming apparatus is in the standby mode; determining that the image forming apparatus is in a low input state that does not satisfy a predetermined input condition based on the detected one of the electric voltage, the electric current, and the electric power; and issuing a notification that urges a recovery operation of the image forming apparatus.

14 Claims, 10 Drawing Sheets

(56) References Cited

U.S. PATENT DOCUMENTS

| | | | | |
|---|---|---|---|---|
| 2014/0270824 | A1 | 9/2014 | Satoh et al. | |
| 2014/0270873 | A1 | 9/2014 | Kato et al. | |
| 2014/0376938 | A1 | 12/2014 | Yamaoka et al. | |
| 2015/0346654 | A1* | 12/2015 | Saito | G03G 15/2039 399/33 |
| 2016/0342115 | A1* | 11/2016 | Takane | G03G 15/205 |
| 2017/0336741 | A1* | 11/2017 | Kikegawa | G03G 15/2039 |

* cited by examiner

CONTROL METHOD OF IMAGE FORMING APPARATUS

CROSS-REFERENCE TO RELATED APPLICATION

This patent application is based on and claims priority pursuant to 35 U.S.C. § 119 to Japanese Patent Application No. 2016-101545, filed on May 20, 2016, in the Japanese Patent Office, the entire disclosure of which is hereby incorporated by reference herein.

BACKGROUND

Technical Field

Exemplary aspects of the present disclosure relate to a control method of an image forming apparatus, and more particularly, to a control method of an image forming apparatus such as a copier, a printer, a facsimile machine, and a multifunction peripheral.

Description of the Background

Related-art image forming apparatuses, such as copiers, facsimile machines, printers, multifunction peripherals, and multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved control method of an image forming apparatus including a fixing rotator. In one exemplary embodiment, the control method includes transiting the image forming apparatus to a standby mode; detecting a temperature of the fixing rotator when the image forming apparatus is in the standby mode; determining that the fixing rotator is in a low temperature state that does not satisfy a predetermined heating condition based on the detected temperature of the fixing rotator; detecting at least one of an electric voltage, an electric current, and an electric power input to the image forming apparatus when the image forming apparatus is in the standby mode; determining that the image forming apparatus is in a low input state that does not satisfy a predetermined input condition based on the detected one of the electric voltage, the electric current, and the electric power; and issuing a notification that urges a recovery operation of the image forming apparatus.

This specification further describes an improved control method of an image forming apparatus including a fixing rotator. In one exemplary embodiment, the control method includes transiting the image forming apparatus to a standby mode; detecting a temperature of the fixing rotator when the image forming apparatus is in the standby mode; determining that the fixing rotator is in a low temperature state that does not satisfy a predetermined heating condition based on the detected temperature of the fixing rotator; detecting at least one of an electric voltage, an electric current, and an electric power input to the image forming apparatus when the image forming apparatus is in the standby mode; determining that the image forming apparatus is in a low input state that does not satisfy a predetermined input condition based on the detected one of the electric voltage, the electric current, and the electric power; and performing a recovery operation of the image forming apparatus automatically.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
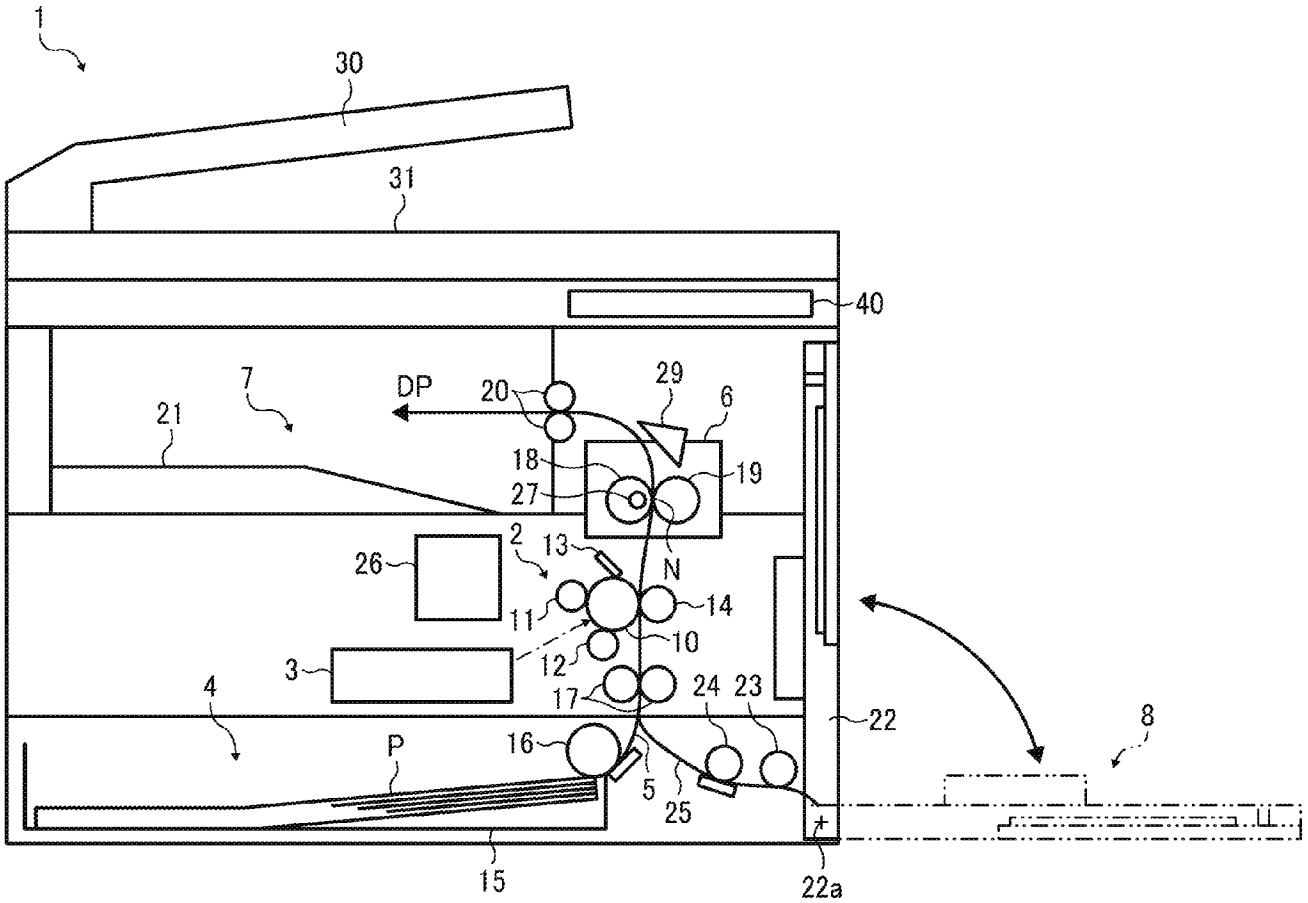
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a monochrome copier that forms a monochrome toner image on a recording medium by electrophotography. Alternatively, the image forming apparatus 1 may be a color copier that forms a color toner image on a recording medium.

Figure 2:
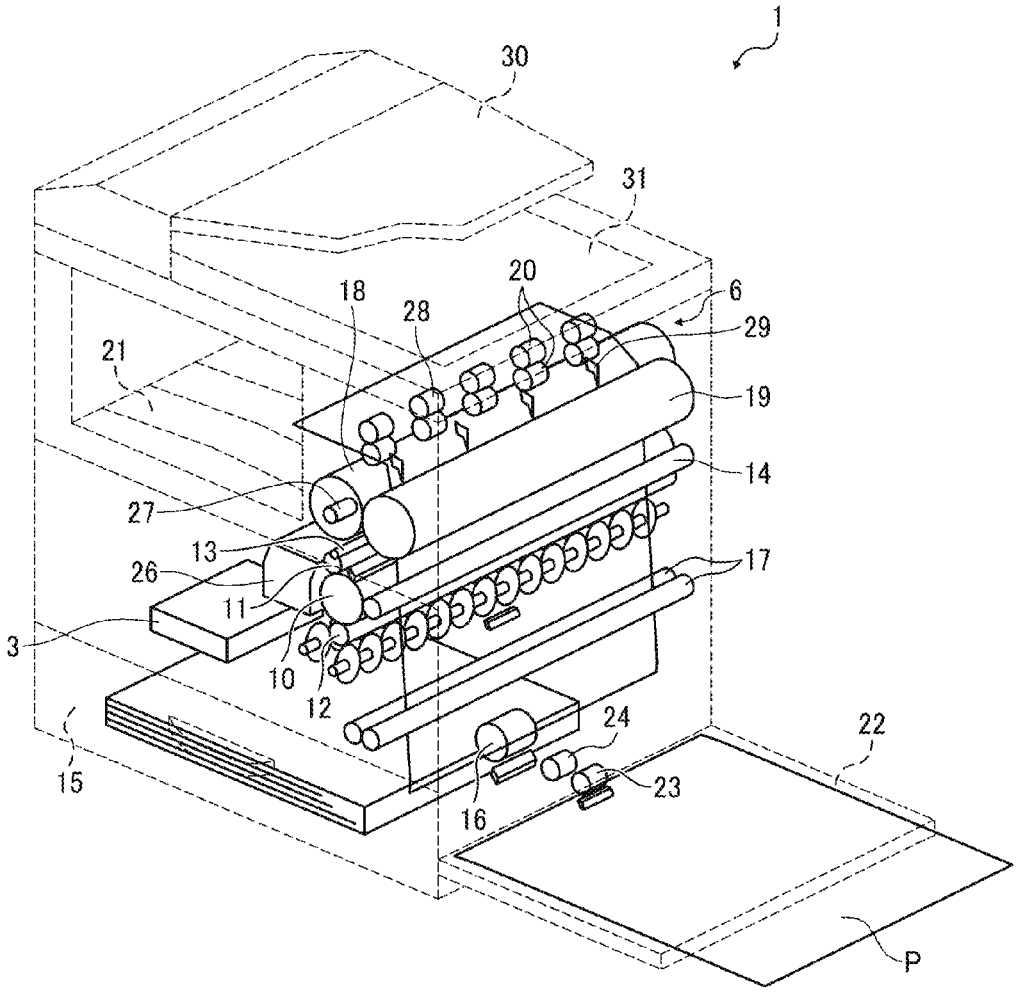
FIG. 2 is a perspective view of the image forming apparatus depicted in FIG. 1, illustrating a fixing device incorporated therein.

Referring to FIGS. 1 and 2, a description is provided of a construction of the image forming apparatus 1.

FIG. 1 is a schematic vertical cross-sectional view of the image forming apparatus 1. FIG. 2 is a perspective view of the image forming apparatus 1. Identical reference numerals are assigned to identical components or equivalents and description of the components is simplified or omitted.

As illustrated in FIG. 1, the image forming apparatus 1 includes a process unit 2 that is removably installed in the image forming apparatus 1. The process unit 2 includes a photoconductive drum 10, a charging roller 11, a developing device 12, and a cleaning blade 13. The photoconductive drum 10 serves as a drum-shaped rotator that bears a developer containing toner on an outer circumferential surface of the photoconductive drum 10. The charging roller 11 uniformly charges the outer circumferential surface of the photoconductive drum 10. The developing device 12 supplies toner onto the outer circumferential surface of the photoconductive drum 10 to visualize an electrostatic latent image formed on the photoconductive drum 10 as a toner image. The cleaning blade 13 cleans the outer circumferential surface of the photoconductive drum 10. Adjacent to the developing device 12 is a toner bottle 26 that supplies toner to the developing device 12.

Below the process unit 2 is an optical writing device 3. The optical writing device 3 emits a laser beam onto the outer circumferential surface of the photoconductive drum 10 according to image data, thus forming the electrostatic latent image on the photoconductive drum 10.

A transfer roller 14 contacts the photoconductive drum 10 to transfer the toner image formed on the outer circumferential surface of the photoconductive drum 10 onto a sheet P. The transfer roller 14 contacts the photoconductive drum 10 to form a transfer nip therebetween. The transfer roller 14 is applied with at least one of a predetermined direct current (DC) voltage and a predetermined alternating current (AC) voltage.

In a lower portion of the image forming apparatus 1 is a sheet feeder 4 including a paper tray 15 that loads a plurality of sheets P serving as recording media and a feed roller 16 that picks up and feeds a sheet P from the paper tray 15 toward a conveyance path 5. Downstream from the feed roller 16 in a sheet conveyance direction DP is a registration roller pair 17.

The sheets P may be thick paper, postcards, envelopes, plain paper, thin paper, coated paper, art paper, tracing paper, overhead projector (OHP) transparencies, and the like.

A bypass sheet feeder 8 is provided separately from the sheet feeder 4. The bypass sheet feeder 8 includes a bypass tray 22, a bypass feed roller 23, a bypass separation roller 24, and a bypass feed path 25. The bypass feed roller 23 feeds an uppermost sheet P of a plurality of sheets P placed on the bypass tray 22 toward an interior of the image forming apparatus 1. The bypass separation roller 24 separates the sheet P fed by the bypass feed roller 23 from other sheets P placed on the bypass tray 22. The bypass tray 22 is rotatable about a shaft 22*a*.

A fixing device 6 (e.g., a fuser or a fusing unit) includes a fixing heater 27, a fixing roller 18, a pressure roller 19, a thermistor 28 depicted in FIG. 2, and a separation claw 29. The fixing heater 27 serves as a heater that heats the fixing roller 18. The fixing roller 18 serves as a fixing rotator or a fixing member that is heated by the fixing heater 27. The pressure roller 19 presses against the fixing roller 18. The thermistor 28 serves as a temperature detector that detects a temperature of an outer circumferential surface of the fixing roller 18. The separation claw 29 separates the sheet P from the fixing roller 18. The fixing device 6 further includes a thermostat to prevent overheating of the fixing roller 18.

A sheet ejector 7 is disposed at a downstream end of the conveyance path 5 in the sheet conveyance direction DP. The sheet ejector 7 includes an output roller pair 20 and an output tray 21. The output roller pair 20 ejects the sheet P onto an outside of the image forming apparatus 1. The output tray 21 stocks the sheet P ejected by the output roller pair 20.

In an upper portion of the image forming apparatus 1 is an auto document feeder (ADF) 30 and a scanner 31. A control panel 40 is disposed at a predetermined position on an exterior face of the image forming apparatus 1. Alternatively, the image forming apparatus 1 may be a printer that is coupled to a client computer and includes a controller that controls image formation according to image data sent from the client computer. In this case, the image forming apparatus 1 does not incorporate the scanner 31 and the ADF 30.

Referring to FIGS. 1 and 2, a description is provided of an image forming operation performed by the image forming apparatus 1.

As a print job starts, the charging roller 11 uniformly charges the outer circumferential surface of the photoconductive drum 10. The optical writing device 3 emits a laser beam onto the charged outer circumferential surface of the photoconductive drum 10 according to image data. The laser beam decreases an electric potential of an irradiation portion on the photoconductive drum 10 that is irradiated with the laser beam, thus forming an electrostatic latent image on the photoconductive drum 10. The developing device 12 supplies toner to the electrostatic latent image formed on the outer circumferential surface of the photoconductive drum 10, visualizing the electrostatic latent image as a toner image that is developed with a developer (e.g., toner).

On the other hand, as the print job starts, the feed roller 16 of the sheet feeder 4 disposed in the lower portion of the image forming apparatus 1 is driven and rotated to feed a sheet P from the paper tray 15 to the conveyance path 5.

If a user places a plurality of sheets P on the bypass tray 22 of the bypass sheet feeder 8, the bypass feed roller 23 feeds an uppermost sheet P from the bypass tray 22 to the interior of the image forming apparatus 1. The bypass separation roller 24 separates the sheet P fed by the bypass feed roller 23 from other sheets P placed on the bypass tray 22 and conveys the sheet P from the bypass feed path 25 to the conveyance path 5.

The registration roller pair 17 conveys the sheet P sent to the conveyance path 5 to the transfer nip formed between the transfer roller 14 and the photoconductive drum 10 at a time when the toner image formed on the outer circumferential surface of the photoconductive drum 10 reaches the transfer nip. The transfer roller 14 transfers the toner image formed on the photoconductive drum 10 onto the sheet P.

After the toner image is transferred onto the sheet P, the cleaning blade 13 removes residual toner failed to be transferred onto the sheet P and therefore remaining on the photoconductive drum 10 therefrom.

The sheet P bearing the toner image is conveyed to the fixing device 6. In the fixing device 6, the thermistor 28 detects the temperature of the fixing roller 18 so that turning on and off of the fixing heater 27 is controlled based on the detected temperature of the fixing roller 18.

A biasing member (e.g., a spring) presses the pressure roller 19 against the fixing roller 18 constantly or inconstantly to form a fixing nip N between the pressure roller 19 and the fixing roller 18. As the sheet P bearing the toner image is conveyed through the fixing nip N, the fixing roller 18 and the pressure roller 19 fix the toner image on the sheet P under heat and pressure, fixing the toner image on the sheet P. The separation claw 29 separates the sheet P bearing the fixed toner image from the fixing roller 18. The output roller pair 20 ejects the sheet P bearing the fixed toner image onto the output tray 21.

A description is provided of a construction of the control panel 40 of the image forming apparatus 1.

Figure 3:
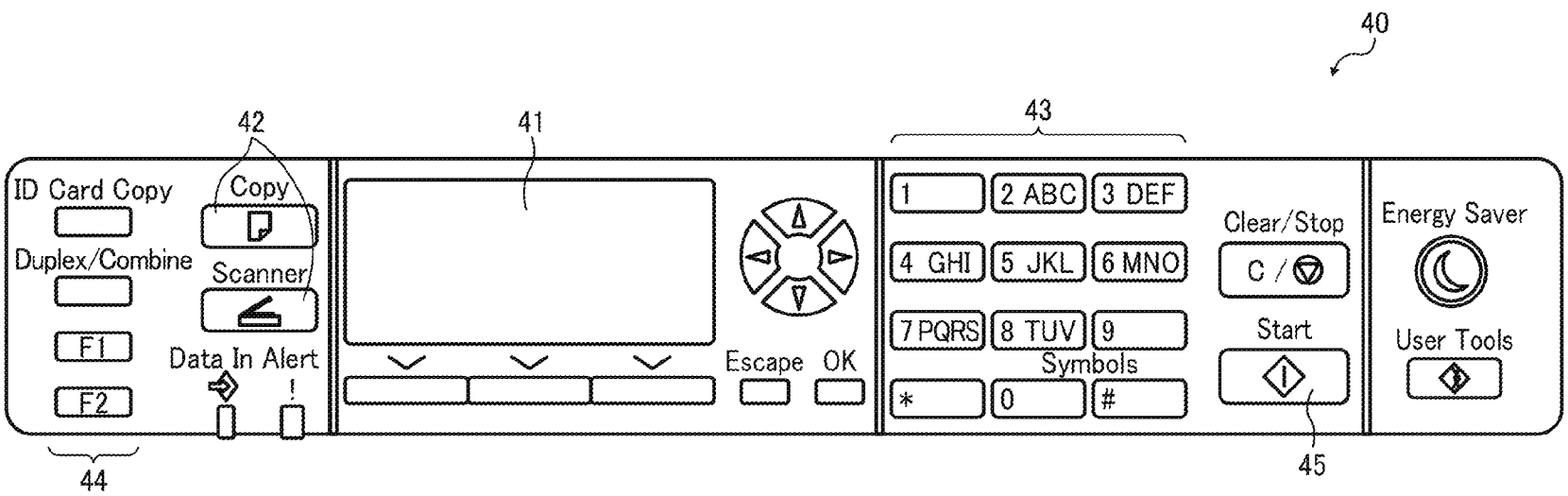
FIG. 3 is a plan view of a control panel incorporated in the image forming apparatus depicted in FIG. 1.

FIG. 3 is a plan view of the control panel 40. As illustrated in FIG. 3, the control panel 40 includes a liquid crystal panel 41 that displays a menu, an error of the image forming apparatus 1, and the like. Around the liquid crystal panel 41 are a plurality of keys with which the user inputs instructions such as an instruction for printing and makes settings. For example, the plurality of keys includes a plurality of feature keys 42 to switch between copying and scanning; a plurality of numeric keys 43; a plurality of function keys 44; and a start key 45 to start a job such as a copy job.

The user makes various settings for printing while watching a selection screen displayed on the liquid crystal panel 41. The user presses the start key 45 to start a job such as a print job. When a controller of the image forming apparatus 1 detects an error or the controller urges the user to perform a predetermined operation, the liquid crystal panel 41 displays an instruction.

A description is provided of control components of the image forming apparatus 1.

Figure 4:
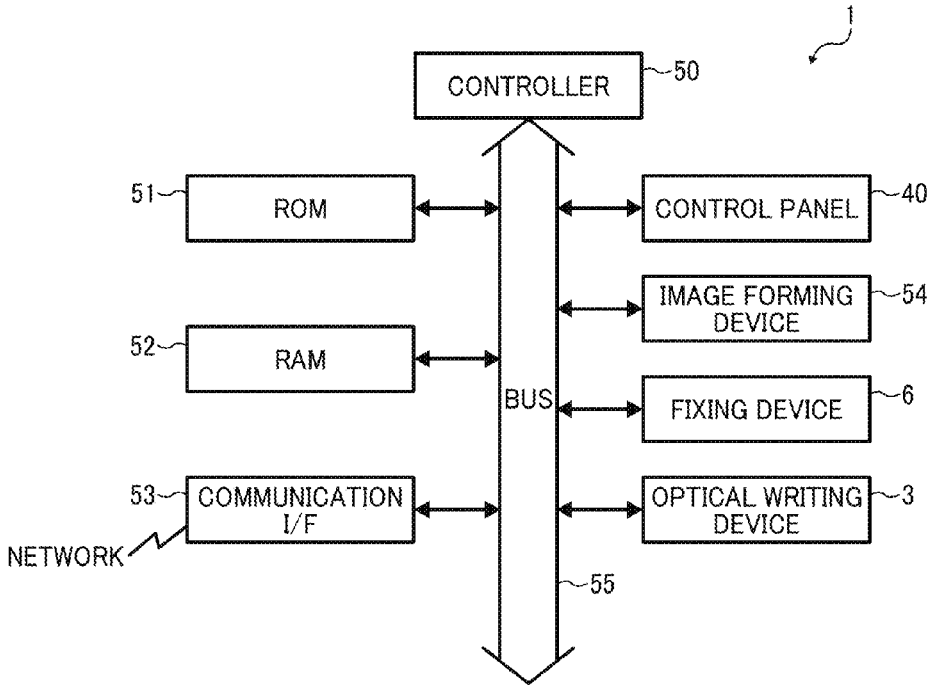
FIG. 4 is a block diagram of the image forming apparatus depicted in FIG. 1.

FIG. 4 is a block diagram of the image forming apparatus 1. As illustrated in FIG. 4, the image forming apparatus 1 includes a controller 50, a read only memory (ROM) 51, a random access memory (RAM) 52, a communication interface (I/F) 53, the control panel 40, an image forming device 54, the fixing device 6, and the optical writing device 3, which are connected through a bus 55. The image forming device 54 includes the process unit 2 and the transfer roller 14 depicted in FIG. 1.

The ROM 51 stores various programs including a basic program of the image forming apparatus 1 and a fixing control program described below. The ROM 51 prestores data used to execute each of the programs.

The RAM 52 is used as a working memory of the controller 50. The RAM 52 writes various data used by the controller 50 while the controller 50 executes the program.

The controller 50 uses the RAM 52 as a working memory based on the program stored by the ROM 51 to control each component of the image forming apparatus 1 so that the image forming apparatus 1 performs a print job. For example, the controller 50 performs a fixing control described below.

The communication I/F 53 is connected to a network such as a local area network (LAN). The communication I/F 53 sends and receives image data to and from an external device through the network.

Figure 5:
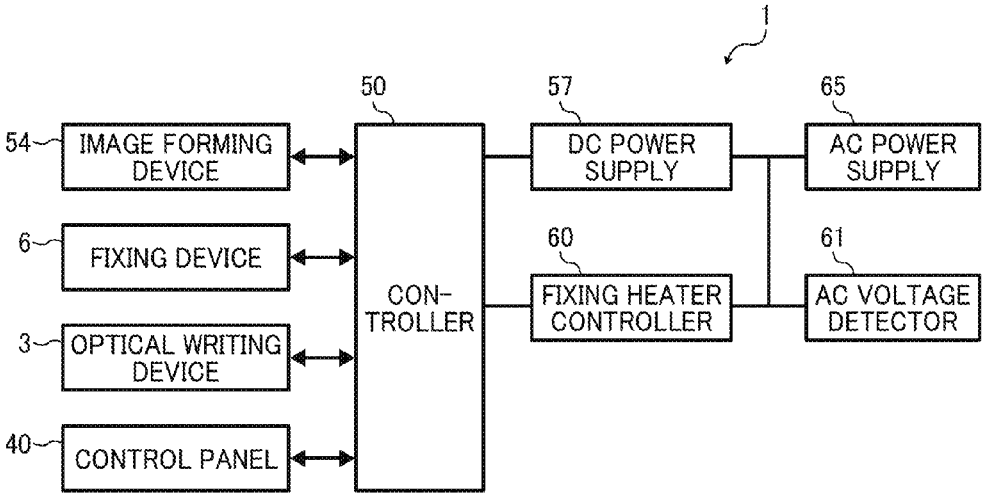
FIG. 5 is a block diagram of the image forming apparatus, illustrating an alternating current voltage detector and a fixing heater controller incorporated in the image forming apparatus depicted in FIG. 1.
Figure 6:
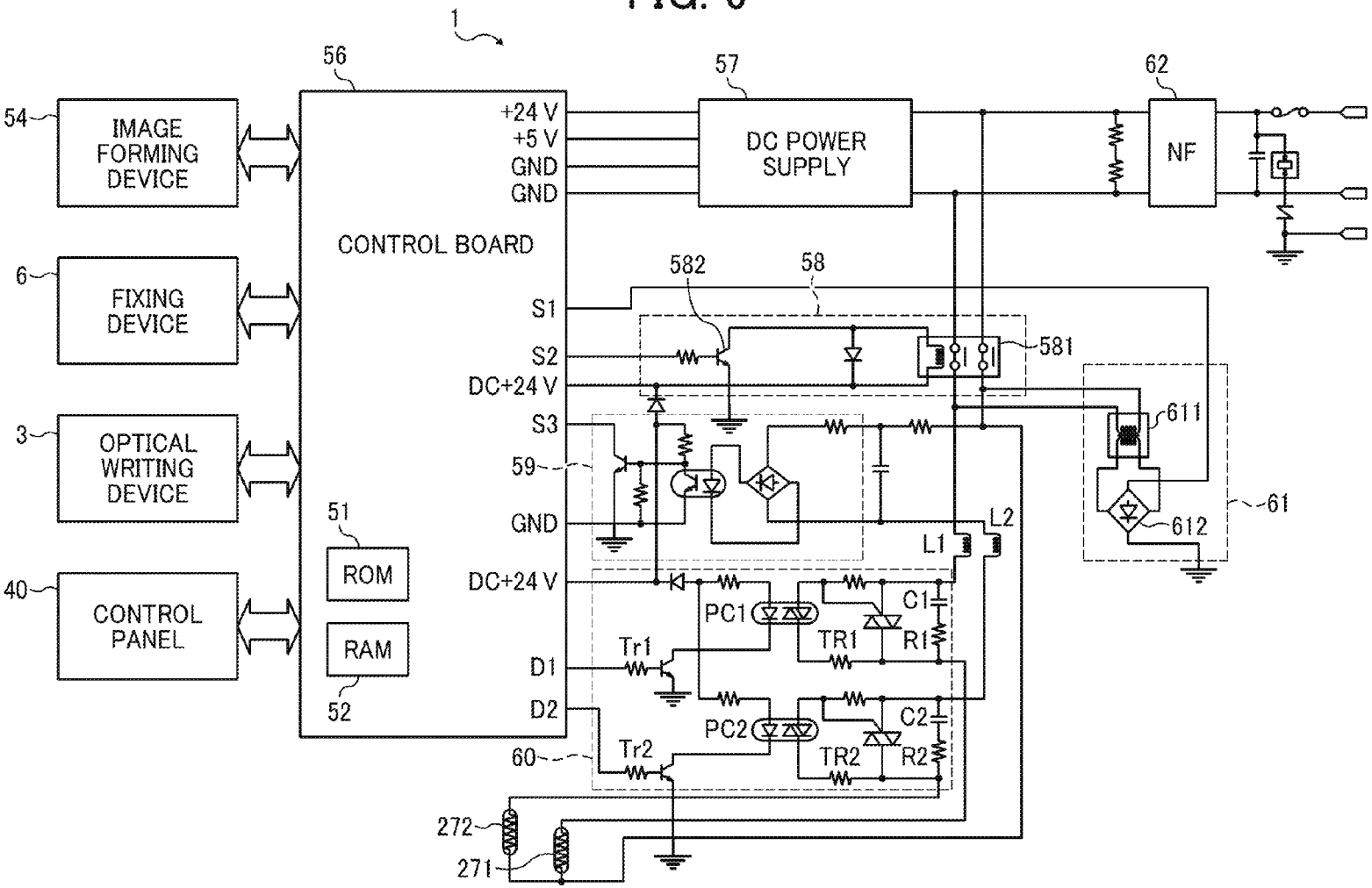
FIG. 6 is a circuit diagram of the alternating current voltage detector and the fixing heater controller depicted in FIG. 5.

FIG. 5 is a block diagram of the image forming apparatus 1, illustrating an alternating current (AC) voltage detector 61 and a fixing heater controller 60. As illustrated in FIG. 5, the image forming apparatus 1 includes the AC voltage detector 61 that detects a voltage input from an alternating current (AC) power supply 65 to the image forming apparatus 1. The fixing heater controller 60 controls turning on and off of the fixing heater 27 depicted in FIG. 1. FIG. 6 is a circuit diagram of the AC voltage detector 61 and the fixing heater controller 60 depicted in FIG. 5.

The control panel 40 includes various keys used to operate the image forming apparatus 1 and the liquid crystal panel 41 as described above with reference to FIG. 3. The control panel 40 displays various information on the liquid crystal panel 41 under control of the controller 50 and outputs an instruction input by the user with the keys to the controller 50.

As illustrated in FIG. 6, the controller 50 depicted in FIG. 5 is mounted on a control board 56 that mounts the ROM 51 and the RAM 52.

The control board 56 is coupled to the image forming device 54, the fixing device 6, the optical writing device 3, the control panel 40, and the like. The control board 56 is further coupled to a direct current (DC) power supply 57, a fixing heater relay controller 58, a zero cross detector 59, the fixing heater controller 60, the AC voltage detector 61, and the like. The DC power supply 57 is supplied with external power (e.g., commercial power) of an alternating current of 100 V through a noise filter (NF) 62. A power supply cable is interposed between the noise filter 62 and the DC power supply 57. The power supply cable is connected to the fixing heater 27 through the fixing heater relay controller 58 and the fixing heater controller 60. The fixing heater 27 heats the fixing roller 18 of the fixing device 6.

A detailed description is now given of a configuration of the DC power supply 57. The DC power supply 57 performs rectification and voltage regulation which convert the external power of the alternating current of 100 V supplied through the noise filter 62 into a direct current. The DC power supply 57 supplies the direct current to each component of the image forming apparatus 1 through the control board 56.

A detailed description is now given of a configuration of the fixing heater relay controller 58.

The fixing heater relay controller 58 includes a fixing heater relay 581 and a transistor 582. The fixing heater relay controller 58 controls a relay control signal S2 for supplying power to the fixing heater 27, that is input to a base of the transistor 582 from the control board 56. Thus, the fixing heater relay controller 58 turns on and off the fixing heater relay 581 to control power supply to the fixing heater 27, that is, to start and stop power supply to the fixing heater 27. For example, the controller 50 mounted on the control board 56 outputs the relay control signal S2 for supplying power to the fixing heater 27 to the transistor 582 such that the fixing heater 27 is supplied with power when the image forming apparatus 1 is powered on and the fixing heater 27 is turned off when the fixing heater 27 is faulty.

A detailed description is now given of a configuration of the zero cross detector 59.

The zero cross detector 59 includes a full wave rectifying circuit and a voltage comparing circuit. The zero cross detector 59 is supplied with the external power of the alternating current of 100 V through the noise filter 62 and the fixing heater relay controller 58. The zero cross detector 59 detects a zero-crossing time of the voltage supplied from the AC power supply 65 and generates a zero-crossing time signal S3 at the detected zero-crossing time. The zero-crossing time signal S3 is input to the control board 56 and connected to an interrupt signal of the controller 50 mounted on the control board 56, thus being defined as a reference time for various controls relating to the alternating current, for example, a control for supplying power to the fixing heater 27.

A detailed description is now given of a configuration of the fixing heater controller 60.

The fixing heater controller 60 includes coils L1 and L2, condensers C1 and C2, resistors R1 and R2, triacs TR1 and TR2, photocouplers PC1 and PC2, and transistors Tr1 and Tr2. The fixing heater 27 includes a first heater 271 and a second heater 272. The first heater 271 is coupled to a resonance circuit constructed of the condenser C1, the resistor R1, and the coil L1. The second heater 272 is coupled to a resonance circuit constructed of the condenser C2, the resistor R2, and the coil L2. When the control board 56 inputs fixing heater control signals D1 and D2 to the transistors Tr1 and Tr2, respectively, the photocouplers PC1 and PC2 are turned on and the triacs TR1 and TR2 are turned on. The resonance circuit constructed of the resistor R1, the coil L1, and the condenser C1 causes the first heater 271 to generate heat. The resonance circuit constructed of the resistor R2, the coil L2, and the condenser C2 causes the second heater 272 to generate heat. Thus, the first heater 271 and the second heater 272 heat the fixing roller 18 of the fixing device 6. Thereafter, when a polarity of an electric voltage reverses, the triacs TR1 and TR2 are turned off by a property of the triacs TR1 and TR2, interrupting power supply to the first heater 271 and the second heater 272.

A detailed description is now given of a configuration of the AC voltage detector 61.

The AC voltage detector 61 includes a transformer 611 and a diode bridge 612. The transformer 611 is supplied with the external power through the noise filter 62. Thus, the AC voltage detector 61 is supplied with the external power through the fixing heater relay controller 58. The AC voltage detector 61 converts the external power from an alternating current to a direct current and inputs the direct current to the control board 56 through the diode bridge 612 so that the control board 56 detects the voltage of the external power.

The AC voltage detector 61 detects the voltage of the alternating current of the external power and inputs the detected voltage to the control board 56. The control board 56 is installed with a resistor that converts the detected voltage into a voltage that is detectable by an analog-to-digital (A/D) converter. The A/D converter performs digital conversion on the converted voltage. Thus, the AC voltage detector 61 detects the voltage of the alternating current. If the external power is commercial power, a voltage waveform is a sine wave of 50 Hz or 60 Hz. Accordingly, a sampling cycle for the voltage of the alternating current is accelerated sufficiently. An alternating current voltage detection signal S1 is input to the control board 56 so that the control board 56 stores information of the voltage of the alternating current for a unit time of control interval.

A description is provided of a configuration of a comparative image forming apparatus.

After a print job is finished, if the comparative image forming apparatus has not received a subsequent print job for a predetermine time period, the comparative image forming apparatus may interrupt power supply to a part of components incorporated in the comparative image forming apparatus and may transit to a standby mode in which the comparative image forming apparatus waits for the subsequent print job. In the standby mode, a heater may heat a fixing rotator (e.g., a fixing roller and a fixing belt) so that the fixing rotator retains a predetermined temperature or higher.

However, the heater may suffer from an error or a failure and may fail to heat the fixing rotator sufficiently. Accordingly, the fixing rotator may suffer from a low temperature state.

In order to address the low temperature state of the fixing rotator, the comparative image forming apparatus may employ a first comparative control method to detect the low temperature state of the fixing rotator. For example, while the heater heats the fixing rotator, a temperature of the fixing rotator is detected. If the detected temperature of the fixing rotator is below a predetermined reference temperature, the low temperature state of the fixing rotator is identified.

If the low temperature state of the fixing rotator is identified, a controller determines that the comparative image forming apparatus suffers from an error, stops the comparative image forming apparatus, and notifies a service engineer or the like, who performs maintenance, of the error of the comparative image forming apparatus. The service engineer repairs the heater of the comparative image forming apparatus, thus recovering the comparative image forming apparatus.

The comparative image forming apparatus may employ a second comparative control method to detect a voltage input from an alternating current power supply to prevent decrease in the voltage of the alternating current.

When the comparative image forming apparatus is in the standby mode, the fixing rotator may not be heated to the predetermined reference temperature due to failure of a power supply coupled to the comparative image forming apparatus other than the failure of the heater described above. For example, if a voltage input to the comparative image forming apparatus from the power supply is low, the heater may not heat the fixing rotator sufficiently, causing the fixing rotator to suffer from the low temperature state. If the power supply is unstable, the fixing rotator is susceptible to the low temperature state due to the low voltage input to the comparative image forming apparatus.

Under the first comparative control method to identify the low temperature state of the fixing rotator based on the temperature of the fixing rotator and determine that the comparative image forming apparatus suffers from an error, even if the comparative image forming apparatus suffers from no error and the fixing rotator is heated slowly due to the low voltage, the controller may stop the comparative image forming apparatus and may notify the service engineer of the error of the comparative image forming apparatus. In this case, the service engineer may visit an office where the comparative image forming apparatus is located unnecessarily. Additionally, a user may not use the comparative image forming apparatus until the service engineer recovers the comparative image forming apparatus. Thus, the first comparative control method may not address the low temperature state of the fixing rotator properly according to a cause of the low temperature state.

After a print job is finished, if the image forming apparatus 1 depicted in FIG. 1 has not received a subsequent print job for a predetermine time period, the image forming apparatus 1 may transit to a standby mode in which the image forming apparatus 1 waits for the subsequent print job. In the standby mode, the fixing heater 27 heats the fixing roller 18 again so that the fixing roller 18 retains a predetermined temperature or higher to prepare for the subsequent print job.

The image forming apparatus 1 in the standby mode detects a low temperature state of the fixing roller 18 in which the fixing heater 27 does not heat the fixing roller 18 sufficiently. The image forming apparatus 1 controls the fixing heater 27 to address the low temperature state of the fixing roller 18.

A description is provided of a first control method performed by the image forming apparatus 1 to address the low temperature state of the fixing roller 18.

Figure 7:
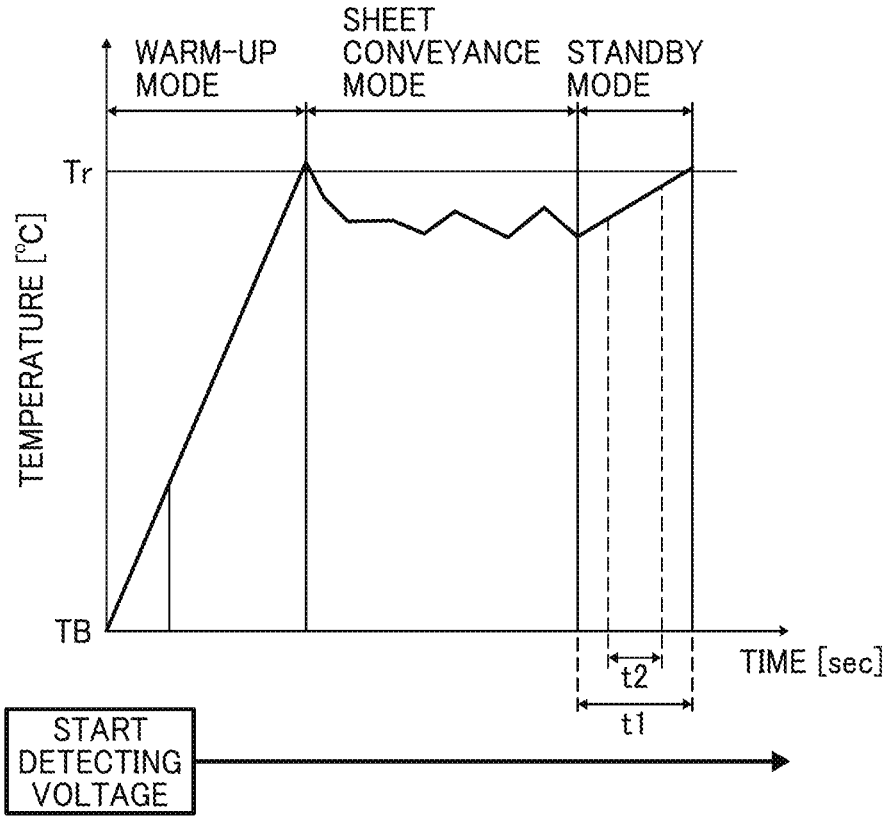
FIG. 7 is a graph illustrating a relation between the time and the temperature of a fixing roller incorporated in the fixing device depicted in FIG. 2.

FIG. 7 is a graph illustrating a relation between the time and the temperature of the fixing roller 18 as the image forming apparatus 1 transits from a warm-up mode through a sheet conveyance mode to form a toner image on a sheet P to the standby mode. A horizontal axis represents a time t [sec]. A vertical axis represents a temperature T [Celsius] of the fixing roller 18. FIG. 7 illustrates change in the temperature T of the fixing roller 18 as the image forming apparatus 1 transits from the warm-up mode through the sheet conveyance mode to the standby mode. The following describes the warm-up mode, the sheet conveyance mode, and the standby mode in this order. A temperature TB represents a temperature of the fixing roller 18 before the fixing heater 27 heats the fixing roller 18.

When the image forming apparatus 1 is powered on, warming up of the image forming apparatus 1 starts in the warm-up mode. As warming up of the image forming apparatus 1 starts, the fixing heater 27 is supplied with power, thus starting heating the fixing roller 18. When the temperature T of the fixing roller 18 reaches a target fixing temperature Tr at which the fixing roller 18 melts and fixes the toner image on the sheet P properly, warming up of the image forming apparatus 1 finishes. The image forming apparatus 1 transits to the sheet conveyance mode in which the sheet P is conveyed through the fixing device 6. In the sheet conveyance mode, while the fixing roller 18 fixes the toner image on the sheet P, the sheet P and the toner image thereon draw heat from the fixing roller 18, decreasing the temperature T of the fixing roller 18.

When the fixing roller 18 finishes fixing the toner image on the sheet P, that is, when the sheet P has passed through the fixing nip N formed between the fixing roller 18 and the pressure roller 19, the image forming apparatus 1 transits to the standby mode. FIG. 7 illustrates the warm-up mode that starts when the image forming apparatus 1 is powered on and started. Alternatively, the warm-up mode may start when the image forming apparatus 1 in the standby mode receives a subsequent print job or the like. In this case, the image forming apparatus 1 transits to the standby mode from the sheet conveyance mode in which the image forming apparatus 1 performs the subsequent print job.

In the standby mode, the target fixing temperature Tr is used as a target temperature of the fixing roller 18. In the standby mode, the fixing heater 27 heats the fixing roller 18 until the temperature T of the fixing roller 18 reaches the target fixing temperature Tr.

According to this exemplary embodiment, the target fixing temperature Tr of the fixing roller 18 in the standby mode is identical to the target fixing temperature Tr of the fixing roller 18 in the sheet conveyance mode in which the fixing roller 18 fixes the toner image on the sheet P. Alternatively, the target fixing temperature Tr of the fixing roller 18 in the standby mode may be lower or higher than the target fixing temperature Tr of the fixing roller 18 in the sheet conveyance mode.

When a time period t1 elapses after the image forming apparatus 1 enters the standby mode, the controller 50 depicted in FIG. 5 determines whether or not the fixing roller 18 suffers from the low temperature state based on the temperature T of the fixing roller 18 that is detected by the thermistor 28 depicted in FIG. 2. If the detected temperature T of the fixing roller 18 is not higher than the target fixing temperature Tr, the controller 50 determines that the fixing roller 18 is in the low temperature state.

The image forming apparatus 1 transits from the sheet conveyance mode to the standby mode after the sheet P passes through the fixing device 6. For example, when the sheet P having passed through the fixing device 6 passes through the output roller pair 20 disposed downstream from the fixing nip N in the sheet conveyance direction DP as illustrated in FIG. 1 and a conveyance sensor disposed in proximity to the output roller pair detects the sheet P having passed through the output roller pair 20, the image forming apparatus 1 transits to the standby mode. When the image forming apparatus 1 enters the standby mode, the controller 50 starts counting until the time period t1 elapses. Alternatively, the conveyance sensor may be disposed at a predetermined position downstream from the fixing device 6 in the sheet conveyance direction DP.

Figure 8:
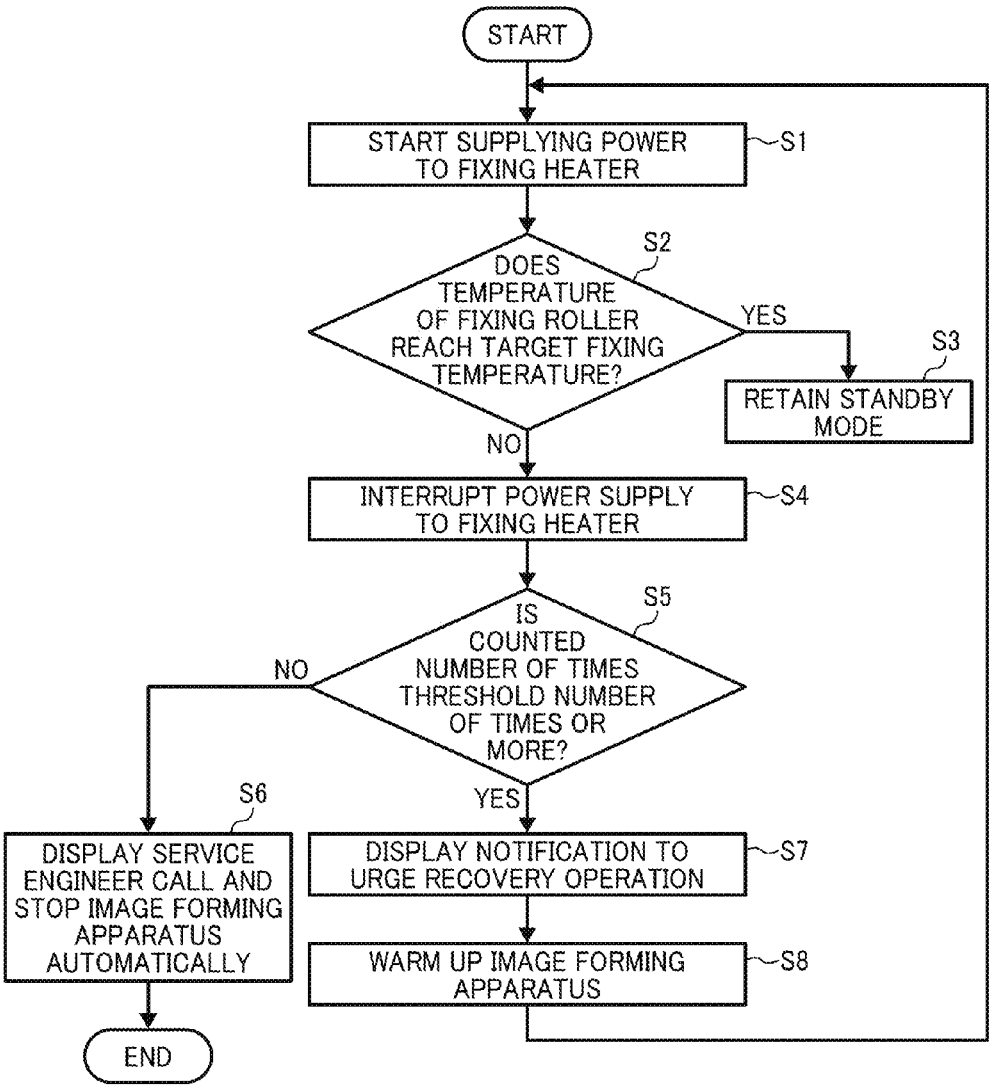
FIG. 8 is a flowchart illustrating processes of a first control method performed by the image forming apparatus depicted in FIG. 1.

FIG. 8 is a flowchart illustrating processes of the first control method performed by the image forming apparatus 1 to address the low temperature state of the fixing roller 18 after the image forming apparatus 1 transits to the standby mode. As illustrated in FIG. 8, when the image forming apparatus 1 transits to the standby mode, the fixing heater controller 60 causes the DC power supply 57 depicted in FIG. 5 to start supplying power to the fixing heater 27 in step S1. Thus, the fixing heater 27 starts heating the fixing roller 18. When the time period t1 elapses after the image forming apparatus 1 transits to the standby mode, the thermistor 28 depicted in FIG. 2 detects the temperature T of the fixing roller 18. The controller 50 depicted in FIG. 5 determines whether or not a heating condition is satisfied, that is, whether or not the temperature T of the fixing roller 18 reaches the target fixing temperature Tr in step S2.

If the controller 50 determines that the temperature T of the fixing roller 18 reaches the target fixing temperature Tr (YES in step S2), the controller 50 determines that the fixing heater 27 heats the fixing roller 18 properly and retains the standby mode of the image forming apparatus 1 in step S3. Conversely, if the controller 50 determines that the temperature T of the fixing roller 18 does not reach the target fixing temperature Tr (NO in step S2), the controller 50 determines that the fixing roller 18 is in the low temperature state and the fixing heater controller 60 interrupts power supply to the fixing heater 27 in step S4.

According to this exemplary embodiment, if the controller 50 detects that the fixing roller 18 is in the low temperature state, the controller 50 determines in which voltage state the image forming apparatus 1 is, a low voltage state (e.g., a low input state) or a normal voltage state (e.g., a normal input state), based on a voltage input to the image forming apparatus 1. After the controller 50 detects the low temperature state of the fixing roller 18, the controller 50 performs processes that vary depending on the voltage state, that is, the low voltage state or the normal voltage state of the image forming apparatus 1.

As illustrated in FIG. 7, the AC voltage detector 61 depicted in FIG. 5 detects the voltage input to the image forming apparatus 1 continuously from the warm-up mode at predetermined intervals. When the controller 50 detects the low temperature state of the fixing roller 18 during the time period t1, the controller 50 refers to the voltage detected for E times during a time period t2 shorter than the time period t1 as illustrated in FIG. 7, thus determining in which voltage state the image forming apparatus 1 is, the low voltage state or the normal voltage state.

For example, the controller 50 counts a number of times when the voltage, which defines the voltage state, detected for E times during the time period t2 is below a predetermined reference voltage V1. The controller 50 determines whether or not the counted number of times is a threshold number of times E0 or more that defines an input condition in step S5. If the counted number of times is the threshold number of times E0 or more, that is, if the input condition is not satisfied, the controller 50 determines that the image forming apparatus 1 is in the low voltage state in which the voltage input to the image forming apparatus 1 is low. Conversely, if the counted number of times is smaller than the threshold number of times E0, the controller 50 determines that the image forming apparatus 1 is in the normal voltage state in which the voltage input to the image forming apparatus 1 is normal or appropriate. The threshold number of times E0 is adjusted according to a predetermined condition such as the predetermined reference voltage V1 or other condition.

The normal voltage state defines a voltage state in which the image forming apparatus 1 is supplied with a voltage at which the image forming apparatus 1 operates properly. Conversely, the low voltage state defines a voltage state in which the image forming apparatus 1 is supplied with a voltage at which the image forming apparatus 1 operates improperly. For example, operation of the image forming apparatus 1 deviates substantially from a normal operation range such as a quality guarantee coverage. For example, in a country where a rated voltage is in a range of from 220 V to 240 V, a voltage input to the image forming apparatus 1 may decrease to 15 percent or less of the rated voltage, that is, 15 percent or less of the quality guarantee coverage of the image forming apparatus 1. Accordingly, the image forming apparatus 1 often suffers from the low voltage state.

If the controller 50 determines that the fixing roller 18 is in the low temperature state under the normal voltage state, the controller 50 sends a service engineer call (SC) serving as a notification signal that notifies an external device of an error that the image forming apparatus 1 suffers from the low temperature state of the fixing roller 18. The liquid crystal panel 41 depicted in FIG. 3 displays the service engineer call caused by the low temperature state of the fixing roller 18. Thereafter, operation of the image forming apparatus 1 stops automatically in step S6.

Upon receiving the service engineer call, the service engineer visits an office where the image forming apparatus 1 is located and recovers the image forming apparatus 1 from the error. For example, if the fixing roller 18 suffers from the low temperature state under the normal voltage state, disconnection of the fixing heater 27 and the thermistor 28 and lifting of the thermistor 28 cause faulty detection of the temperature T of the fixing roller 18 or the like. To address this circumstance, the service engineer recovers the image forming apparatus 1 from the low temperature state of the fixing roller 18 by replacement of parts or the like.

If the controller 50 detects that the fixing roller 18 suffers from the low temperature state under the low voltage state, the liquid crystal panel 41 displays a notification, for example, a message "Power off the image forming apparatus and power on the image forming apparatus again", thus urging the user using the control panel 40 to perform a recovery operation of the image forming apparatus 1 in step S7. The user performs the recovery operation of the image forming apparatus 1 and warming up of the image forming apparatus 1 starts again in step S8. Instead of the above message displayed on the liquid crystal panel 41, the notification issued when the low temperature state of the fixing roller 18 is detected under the low voltage state may be an oral message or may be performed orally and visually.

If the controller 50 detects the low temperature state of the fixing roller 18 under the normal voltage state, the controller 50 determines that the image forming apparatus 1 suffers from an error, stops the image forming apparatus 1, and notifies the service engineer of the error of the image forming apparatus 1, requesting the service engineer to recover the image forming apparatus 1. Conversely, if the controller 50 detects the low temperature state of the fixing roller 18 under the low voltage state, the controller 50 urges the user to perform the recovery operation of the image forming apparatus 1 instead of notifying the service engineer of the error of the image forming apparatus 1. Even if the image forming apparatus 1 suffers from no error, the low voltage state of the image forming apparatus 1 may render the fixing roller 18 to be susceptible to the low temperature state.

Figure 9:
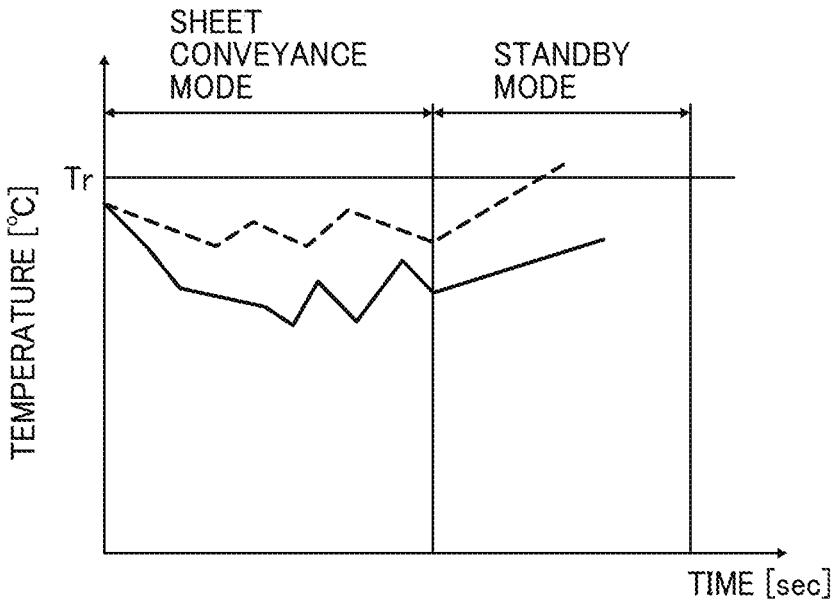
FIG. 9 is a graph illustrating a relation between the time and the temperature of the fixing roller, illustrating change in the temperature of the fixing roller under a low voltage state and change in the temperature of the fixing roller under a normal voltage state.

FIG. 9 is a graph illustrating a relation between the time and the temperature T of the fixing roller 18. FIG. 9 illustrates a solid line that represents change in the temperature T of the fixing roller 18 under the low voltage state and a dotted line that represents change in the temperature T of the fixing roller 18 under the normal voltage state. As illustrated in FIG. 9, an amount of heat conducted from the fixing heater 27 to the fixing roller 18 under the low voltage state is smaller than an amount of heat conducted from the fixing heater 27 to the fixing roller 18 under the normal voltage state, resulting in substantial decrease in the temperature T of the fixing roller 18 while the sheet P is conveyed through the fixing device 6. Accordingly, under the low voltage state, the image forming apparatus 1 transits to the standby mode while the temperature T of the fixing roller 18 is low compared to the temperature T of the fixing roller 18 under the normal voltage state. Further, after the image forming apparatus 1 transits to the standby mode, increase in the temperature T of the fixing roller 18 under the low temperature state is smaller than increase in the temperature T of the fixing roller 18 under the normal temperature state. Under the low voltage state, the temperature T of the fixing roller 18 may not reach the target fixing temperature Tr readily during the time period t1 in the standby mode. Thus, the fixing roller 18 is susceptible to the low temperature state.

To address this circumstance, if the controller 50 detects the low temperature state of the fixing roller 18 caused by the low voltage state, the controller 50 urges the user to perform the recovery operation of the image forming apparatus 1 to warm up the image forming apparatus 1 again, causing the image forming apparatus 1 to transit to the standby mode again after being warmed up as illustrated in FIG. 8. Since the image forming apparatus 1 transits to the standby mode immediately after the warm-up mode, the fixing roller 18 is immune from decrease in the temperature T in the sheet conveyance mode as illustrated in FIG. 7. Accordingly, the image forming apparatus 1 transits to the standby mode while the temperature T of the fixing roller 18 is high. Consequently, even if the fixing heater 27 heats the fixing roller 18 slowly under the low voltage state, the temperature T of the fixing roller 18 reaches the target fixing temperature Tr when the time period t1 elapses.

Since the controller 50 urges the user to perform the recovery operation of the image forming apparatus 1 as described above, even if the fixing roller 18 suffers from the low temperature state due to the low voltage state, the service engineer does not visit the office where the image forming apparatus 1 is located, reducing unnecessary visit of the service engineer. Additionally, the user performs the recovery operation that allows the image forming apparatus 1 to transit quickly to the standby mode properly without waiting for the visit of the service engineer.

A description is provided of a second control method performed by the image forming apparatus 1 to address the low temperature state of the fixing roller 18.

Figure 10:
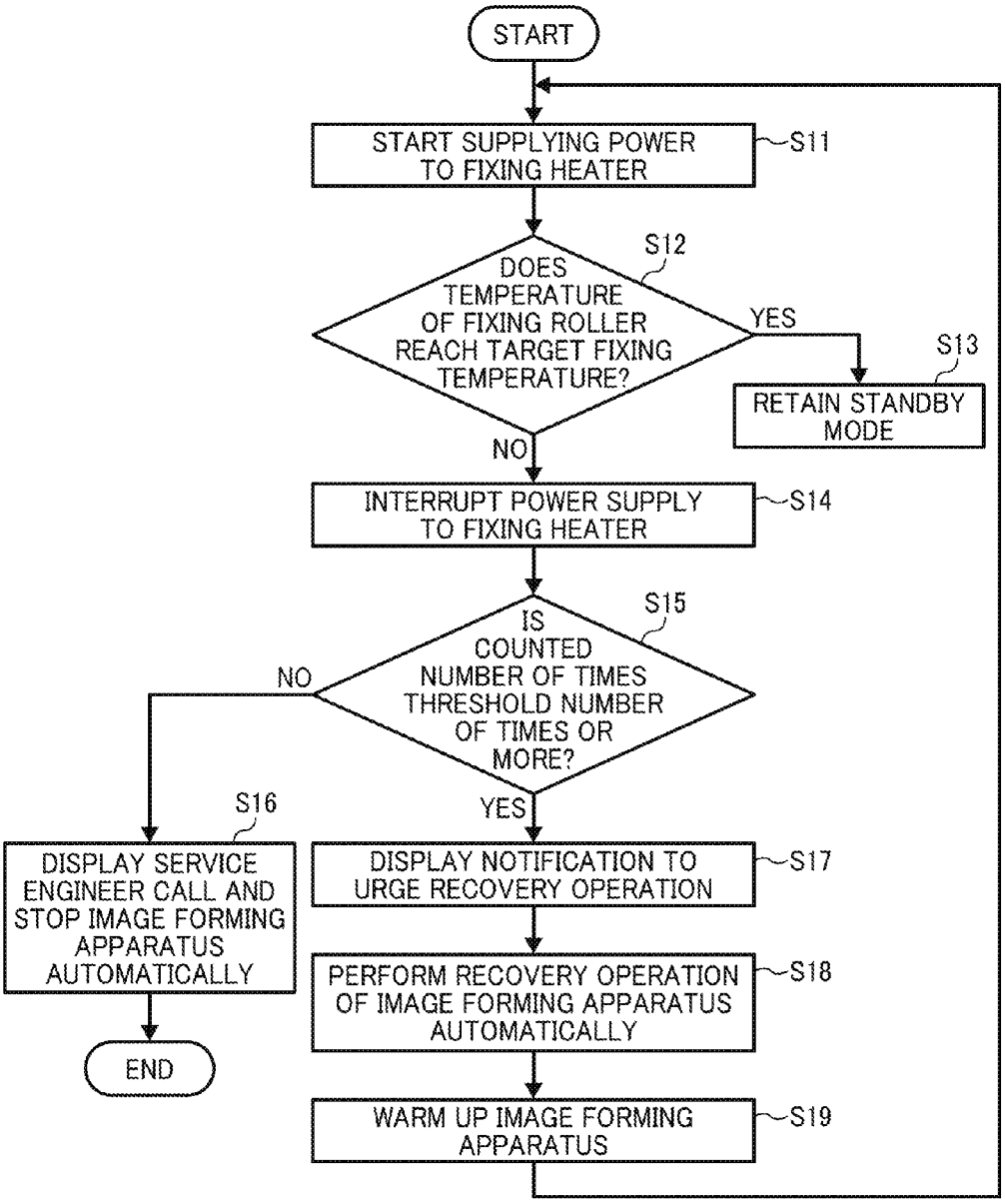
FIG. 10 is a flowchart illustrating processes of a second control method performed by the image forming apparatus depicted in FIG. 1.

FIG. 10 is a flowchart illustrating processes of the second control method performed by the image forming apparatus 1 to address the low temperature state of the fixing roller 18 after the image forming apparatus 1 transits to the standby mode. As illustrated in FIG. 10, the second control method involves steps S11 to S17 that are equivalent to steps S1 and S7 depicted in FIG. 8. Hence, a description of steps S11 to S17 is omitted.

As illustrated in FIG. 10, if the controller 50 detects the low temperature state of the fixing roller 18 under the low voltage state, the controller 50 causes the liquid crystal panel 41 to display the message that urges the user to perform the recovery operation of the image forming apparatus 1 in step S17. When a predetermined time period to elapses after the liquid crystal panel 41 displays the message that urges the user to perform the recovery operation of the image forming apparatus 1 in step S17, the controller 50 performs the recovery operation of the image forming apparatus 1 automatically in step S18. That is, the controller 50 powers off and on the image forming apparatus 1 automatically. The image forming apparatus 1 warms up in step S19.

Alternatively, when the controller 50 detects the low temperature state of the fixing roller 18, the controller 50 may perform the recovery operation of the image forming apparatus 1 automatically without causing the liquid crystal panel 41 to display the message that urges the user to perform the recovery operation of the image forming apparatus 1. Since the controller 50 performs the recovery operation of the image forming apparatus 1 automatically, even if the user is not in front of the image forming apparatus 1 and does not watch the liquid crystal panel 41, the image forming apparatus 1 performs the recovery operation.

Yet alternatively, the controller 50 may switch between the first control method to perform a messaged recovery that causes the liquid crystal panel 41 to display the message that urges the user to perform the recovery operation of the image forming apparatus 1 and the second control method to perform an automatic recovery that causes the image forming apparatus 1 to perform the recovery operation automatically. Thus, the controller 50 may select the first control method or the second control method.

According to this exemplary embodiment, when the controller 50 detects the low temperature state of the fixing roller 18 under the low voltage state, a recovery operation of the fixing device 6 is performed by the recovery operation of the image forming apparatus 1 in which the image forming apparatus 1 is powered off and powered on again. After the warm-up mode of the image forming apparatus 1, the image forming apparatus 1 transits to the standby mode again and the controller 50 counts a standby time period from zero. Alternatively, the recovery operation of the fixing device 6 may be performed by other method. As one example, power supply to the fixing device 6 is interrupted and resumed to count a standby time period from zero, thus starting the standby mode. Alternatively, the standby time period may be reset or a time period until detection of the low temperature state of the fixing roller 18 may be extended. Accordingly, the fixing heater 27 heats the fixing roller 18 in the standby mode for a time period longer than the time period t1 and the controller 50 determines whether or not the fixing roller 18 is in the low temperature state again.

The standby mode described above indicates a state in which the image forming apparatus 1 waits for a recovery instruction or a subsequent print job when the image forming apparatus 1 receives no instruction from the user for a predetermined time period while the image forming apparatus 1 is powered on. In the standby mode, the controller 50 performs any temperature control on the fixing roller 18. The standby mode includes an energy saver mode to save energy. For example, the energy saver mode includes a low power mode in which the controller 50 interrupts power supply to the components of the image forming apparatus 1 except for a part of an engine and decreases the temperature T of the fixing roller 18 when a predetermined time period elapses after the image forming apparatus 1 is used last.

The present disclosure is not limited to the details of the exemplary embodiments described above and various modifications and improvements are possible.

According to the exemplary embodiments described above, the AC voltage detector 61 depicted in FIG. 5 detects the voltage input to the image forming apparatus 1. The controller 50 identifies the normal voltage state (e.g., the normal input state) or the low voltage state (e.g., the low input state) based on the detected voltage and performs processes of the first control method and the second control method that vary depending on the voltage input to the image forming apparatus 1. Alternatively, an electric current or an electric power input to the image forming apparatus 1 may be detected. For example, the controller 50 identifies the low input state if the detected electric current or the detected electric power does not satisfy a predetermined condition. The controller 50 identifies the normal input state if the detected electric current or the detected electric power satisfies the predetermined condition. The controller 50 performs the processes of the first control method and the second control method, as described above in the exemplary embodiments, which vary depending on an input state, that is, the low input state or the normal input state.

Figure 11:
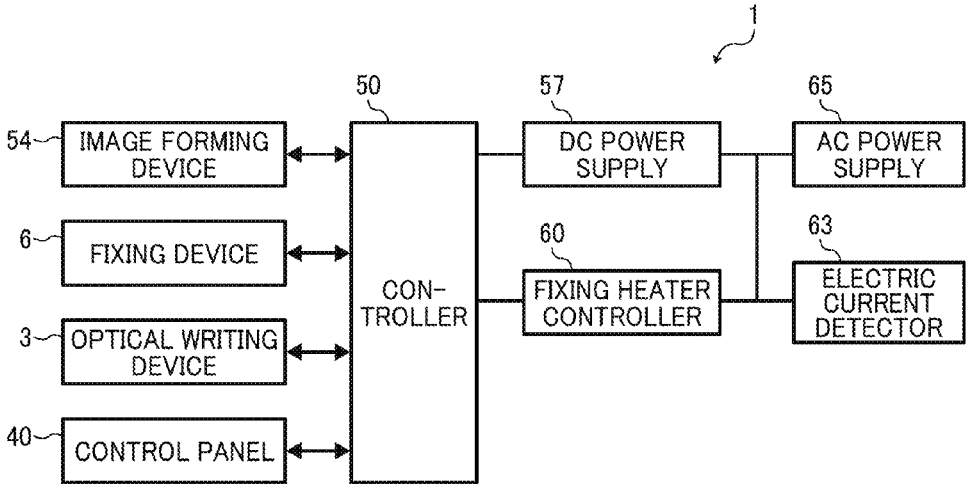
FIG. 11 is a block diagram of the image forming apparatus incorporating an electric current detector instead of the alternating current voltage detector depicted in FIG. 5.

FIG. 11 is a block diagram of the image forming apparatus 1 incorporating an electric current detector 63 instead of the AC voltage detector 61 depicted in FIG. 5. The electric current detector 63 detects an electric current input to the image forming apparatus 1.

Figure 12:
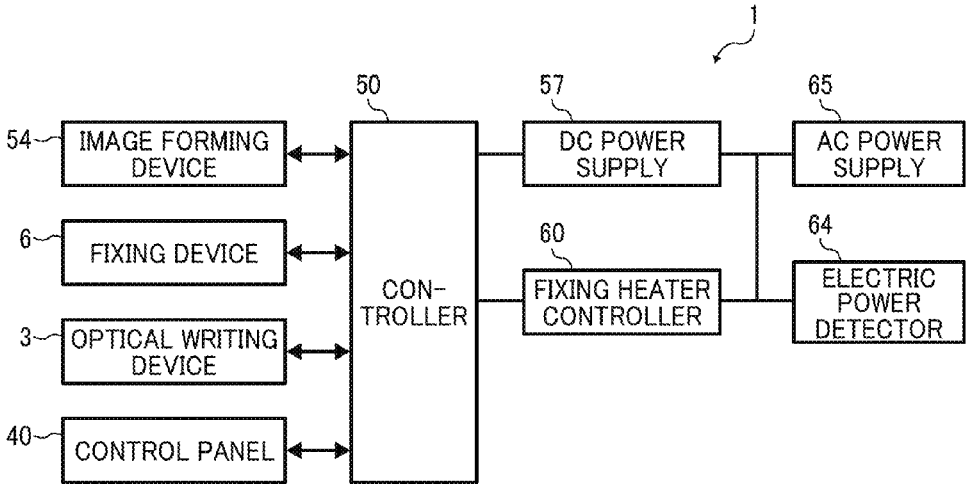
FIG. 12 is a block diagram of the image forming apparatus incorporating an electric power detector instead of the alternating current voltage detector depicted in FIG. 5.

FIG. 12 is a block diagram of the image forming apparatus 1 incorporating an electric power detector 64 instead of the AC voltage detector 61 depicted in FIG. 5. The electric power detector 64 detects an electric power input to the image forming apparatus 1.

The controller 50 calculates in advance a resistance value of the image forming apparatus 1 against the electric current and the like input to the image forming apparatus 1. The controller 50 converts a value of the electric current detected by the electric current detector 63 or the electric power detected by the electric power detector 64 into a value of an electric voltage. The controller 50 compares a condition obtained by the value of the electric voltage with a predetermined voltage condition.

A description is provided of advantages of a control method (e.g., the first control method and the second control method) performed by an image forming apparatus (e.g., the image forming apparatus 1).

The control method of the image forming apparatus includes detecting at least one of an electric voltage, an electric current, and an electric power input to the image forming apparatus when the image forming apparatus is in a standby mode. The control method of the image forming apparatus further includes detecting a temperature of a fixing rotator (e.g., the fixing roller 18) when the image forming apparatus is in the standby mode. The control method of the image forming apparatus further includes determining that the image forming apparatus is in a low input state that does not satisfy a predetermined input condition based on the detected one of the electric voltage, the electric current, and the electric power. The control method of the image forming apparatus further includes determining that the fixing rotator is in a low temperature state that does not satisfy a predetermined heating condition based on the detected temperature of the fixing rotator. The control method of the image forming apparatus further includes issuing a notification that urges a recovery operation of the image forming apparatus.

If the image forming apparatus is in the low input state and the fixing rotator is in the low temperature state, a controller (e.g., the controller 50) does not determine immediately that the image forming apparatus suffers from an error. The controller issues the notification that urges a user to perform the recovery operation of the image forming apparatus. For example, even if the voltage input to the image forming apparatus causes the low input state of the image forming apparatus, that does not satisfy the predetermined input condition, and therefore the fixing rotator is heated slowly, the fixing rotator is heated again after the recovery operation. Thus, the controller addresses the low temperature state of the fixing rotator according to a cause of the low temperature state of the fixing rotator.

According to the exemplary embodiments described above, the fixing roller 18 serves as a fixing rotator. Alternatively, a fixing belt, a fixing film, a fixing sleeve, or the like may be used as a fixing rotator. Further, the pressure roller 19 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A control method of an image forming apparatus including a fixing rotator, the control method comprising:

transiting the image forming apparatus to a standby mode;

detecting a temperature of the fixing rotator when the image forming apparatus is in the standby mode;

determining that the fixing rotator is in a low temperature state that does not satisfy a predetermined heating condition based on the detected temperature of the fixing rotator;

detecting at least one of an electric voltage, an electric current, and an electric power input to the image forming apparatus when the image forming apparatus is in the standby mode;

determining that the image forming apparatus is in a low input state that does not satisfy a predetermined input condition based on the detected one of the electric voltage, the electric current, and the electric power; and issuing a notification that urges a recovery operation of the image forming apparatus.

2. The control method according to claim 1, further comprising:

performing an automatic recovery as the recovery operation of the image forming apparatus automatically when a predetermined time period elapses after issuing the notification.

3. The control method according to claim 2, further comprising:

performing a messaged recovery as the recovery operation of the image forming apparatus, the messaged recovery in which the notification includes a message to urge a user of the image forming apparatus to perform the recovery operation of the image forming apparatus.

4. The control method according to claim 3, further comprising:

switching between the automatic recovery and the messaged recovery.

5. The control method according to claim 3, wherein the message is displayed on a control panel of the image forming apparatus.

6. The control method according to claim 1, further comprising:

performing the recovery operation of the image forming apparatus by powering off the image forming apparatus and powering on the image forming apparatus subsequently.

7. The control method according to claim 1, further comprising:

determining that the image forming apparatus is in a normal input state that satisfies the predetermined input condition based on the detected one of the electric voltage, the electric current, and the electric power.

8. The control method according to claim 7, further comprising:

determining that the fixing rotator is in the low temperature state under the normal input state of the image forming apparatus;

sending a notification signal to an external device, the notification signal to notify the external device of an error of the image forming apparatus; and powering off the image forming apparatus.

9. The control method according to claim 1, further comprising:

detecting the at least one of the electric voltage, the electric current, and the electric power input to the image forming apparatus for a plurality of times within a predetermined time period;

detecting that the detected one of the electric voltage, the electric current, and the electric power is below a predetermined reference value for at least a predetermined number of times; and determining that the image forming apparatus is in the low input state.

10. The control method according to claim 1, further comprising:

determining that the temperature of the fixing rotator does not reach a predetermined target temperature when a predetermined time period elapses after the image forming apparatus transits to the standby mode; and determining that the fixing rotator is in the low temperature state.

11. The control method according to claim 1, wherein the image forming apparatus waits for a print job in the standby mode.

12. The control method according to claim 1, wherein the predetermined heating condition includes a target fixing temperature at which the fixing rotator fixes a toner image on a recording medium.

13. The control method according to claim 1, wherein the predetermined input condition includes a voltage that is higher than 15 percent of a rated voltage.

14. A control method of an image forming apparatus including a fixing rotator, the control method comprising:

transiting the image forming apparatus to a standby mode;

detecting a temperature of the fixing rotator when the image forming apparatus is in the standby mode;

determining that the fixing rotator is in a low temperature state that does not satisfy a predetermined heating condition based on the detected temperature of the fixing rotator;

detecting at least one of an electric voltage, an electric current, and an electric power input to the image forming apparatus when the image forming apparatus is in the standby mode;

determining that the image forming apparatus is in a low input state that does not satisfy a predetermined input condition based on the detected one of the electric voltage, the electric current, and the electric power; and performing a recovery operation of the image forming apparatus automatically.

* * * * *